United States Patent [19]

Nakano

[11] Patent Number: 4,826,373

[45] Date of Patent: May 2, 1989

[54] PIN FOR INJECTING A GROUT MATERIAL

[75] Inventor: Masahiro Nakano, Tokyo, Japan

[73] Assignee: Leo Kaken Co., Ltd., Aichi, Japan

[21] Appl. No.: 39,468

[22] Filed: Apr. 16, 1987

[30] Foreign Application Priority Data

Jul. 11, 1986 [JP] Japan ..... 61-105675[U]

[51] Int. Cl.[4] ..... F16B 39/02

[52] U.S. Cl. ..... 411/82; 411/60; 405/261

[58] Field of Search ..... 156/92, 94; 425/11, 425/13; 264/36; 411/41, 57, 60, 82, 359, 448; 405/259–261; 52/704

[56] References Cited

U.S. PATENT DOCUMENTS

| | | | |
|---|---|---|---|
| 1,202,159 | 10/1916 | Camden | 411/60 |
| 2,829,502 | 4/1958 | Dempsey | 405/261 |
| 3,311,012 | 3/1967 | Williams | 405/260 |
| 3,943,817 | 3/1976 | Mess | 411/434 |
| 4,235,151 | 11/1980 | Udert et al. | 411/60 |
| 4,270,331 | 6/1981 | Lang et al. | 52/704 |
| 4,362,440 | 12/1982 | Glaesmann et al. | 405/260 |
| 4,369,003 | 1/1983 | Brandstetter | 405/260 |
| 4,488,843 | 12/1984 | Achille | 411/60 |

FOREIGN PATENT DOCUMENTS

| | | | |
|---|---|---|---|
| 2287610 | 5/1976 | France | 411/271 |

*Primary Examiner*—Neill R. Wilson

*Attorney, Agent, or Firm*—Kane, Dalsimer, Sullivan, Kurucz, Levy, Eisele & Richard

[57] ABSTRACT

A pin for injecting a grout material comprising an upper structure (I) into which an upper half portion (1') wherein a screw thread (2) and a lengthwise hole (3) are formed, a packing (4), a washer (5) and a knock pin (11) for knocking a grout pin (10) are inserted, and a lower structure (II) into which a lower half portion (1''), both tongued pieces (7', 7'') of a slit wherein said slit (7) and a knurling portion (8) are formed and in the space formed by both tongued pieces (7', 7''), through the lengthwise hole (3) of said upper structure, the grout pin and the knock pin for knocking said grout pin are inserted.

5 Claims, 3 Drawing Sheets

PIN FOR INJECTING A GROUT MATERIAL

FIELD OF THE INVENTION

The present invention relates to a pin for injecting a grout material for reparing or preventing surface peel-off of mortar coated walls or strengthening the inside of a structure destroyed due to weakness thereof.

BACKGROUND OF THE INVENTION

In general, the wall surface to which mortar is coated is apt to peel-off after a long period of time owing to a peel-off phenomenon caused between the mortar wall surface and the wall itself; and at last the so-called peel-off phenomenon may often be observed. Furthermore, it is necessary to integrate the deteriorating mortar wall surface with the wall itself by filling up the space thus caused owing to the cracked or seceded portion of concrete or bricks by employing a suitable adhesive agent.

According to conventional execution of workings, a number of anchor bolts are knocked into almost the entire area estimated as being destroyed; and thereafter a grout material such as cement mortar is injected into a position or place in the vicinity of the estimated destroyed area. However, in the case of the above conventional execution of workings, it was impossible to retain the mortar wall surface as it was owing to a high pressure action at the time of the injection of the grout material and accordingly a space between the mortar wall surface and the wall itself increased owing to the action of the grout material thus injected, which inevitably caused the enlargement of cracks.

SUMMARY OF THE INVENTION

An object of the present invention is to constitute a pin for injecting a grout material without causing the defects of the conventional execution of workings. The above-mentioned object can be attained with a pin for injecting a grout material which comprises an upper structure of a cylinder provied with a screw thread and a lengthwise hole respectively arranged at an upper-half portion which is somewhat shorter than half of the whole thereof, a packing and a washer respectively made of an elastic material such as a rubber or synthetic material etc., being fitted into said shorter, upper-half portion in order to prevent the counter flow of a grout material, a washer based nut being screwed into said screw thread and a knock pin for knocking a grout pin into said hole and a lower construction consisting of a slit formed directly below said packing being arranged at a lower-half portion which is longer than approximately half the length of the whole of said cylinder, a knurling portion being formed on both tongued pieces of said slit of the front end of said lower-half portion and further a knock pin knocking the grout pin being inserted into a space formed by said tongued pieces just like said grout pin through the lengthwise hole of said peel construction.

The present invention is an improvement of a pin for injecting a grout material as disclosed in Japanese Utility Model Application No. Sho 55-80277 (Utility Model Publication No. Sho 60-40766) filed in the name of the present applicant; and according to the present invention, it is possible to inject the pin for injecting the grout material in deeper portions as far as a space of the lengthwise hole in comparison with the aforementioned publicly known pin for injecting a grout pin.

1: cylinder

1',1'': upper-half portion of the cylinder and a lower-half portion thereof

2: screw thread

3: lengthwise hole

4: packing

DETAILED DESCRIPTION OF THE PREFERED EMBODIMENTS OF THE INVENTION

Figure 1:
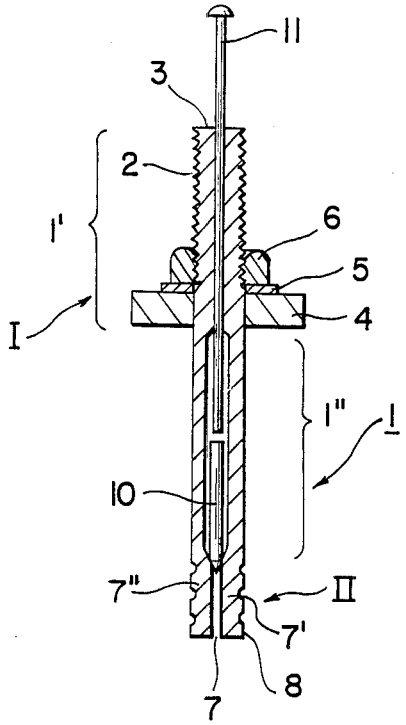
FIG. 1 is a schematic view of a pin for injecting a grout material according to the present invention.

As shown in FIG. 1, a pin for injecting a grout material according to the present invention comprised a cylinder 1. Said cylinder 1 consists of two constructions (I) and (II). Said constructions consist of an upper-half portion 1' which is shorter than approximately half the length of the whole of the whole of said cylinder 1 as the construction (I) and a lower-half portion 1'' which is longer than said portion 1' as the construction (II).

On said upper-half portion 1', a lengthwise hole 3 is perforated to penetrate through the central portion of a screw thread 2 and said cylinder 1. Said hole 3 may serve to insert thereinto a grout pin 10 formed approximately in the shape of a trapezoid and a pin 11 for knocking said grout pin 10 onto said shorter upper-half portion 1', a packing 4 made of, for example, such an elastic material as a rubber or synthetic material etc., for preventing the counter flow of the grout material and provided with a central hole having approximately the same diameter as said cylinder so as to be self-suspended by said cylinder and further a washer 5 abutting said packing 4 are fitted. Furthermore, at the time of an operation, a washer based nut 6 is screwed into a screw thread 2 in order to check the aforementioned constitutional elements. In this case, the washer 5 can retain the pin for injecting a grout material to be a suspended condition because said washer 5 has a larger diameter than that of the hole perforated in the construction into which the pin for injecting the grout material is inserted.

In the lower half portion 1'' which is longer than approximately half the length of the whole of said cylinder 1, a slit 7 is formed directly below the lower portion of said packing 4, while on the other hand two tongued pieces 7', 7'' forming a slit 7 are formed at the front portion of said lower half portion 1'' and furthermore the knurling portion 8 is formed on said tongued pieces 7', 7'' in order to permanently anchor said cylinder to a constructing body when the cylinder is expanded by knocking the grout pin 10 thereinto by means of the knock pin 11.

In carrying out an actual operation, the grout pin 10 is inserted through the lengthwise hole 3 of the aforesaid construction and the knock pin 11 is also inserted in order to knock same thereinto.

Hereinafter, embodiment of the use of the pin for injecting a grout material according to the present invention will be described in detail with reference to the FIG. 2 to FIG. 8.

Figure 2:
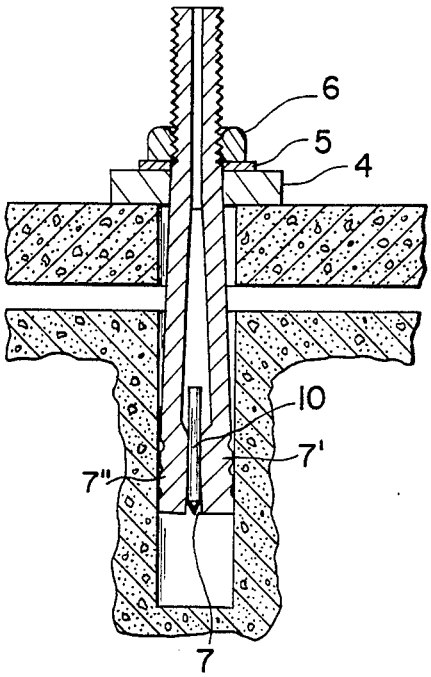
FIG. 2 to FIG. 6 are an execution process of wordings by employing the pin for injecting a grout material according to the present invention.
Figure 3:
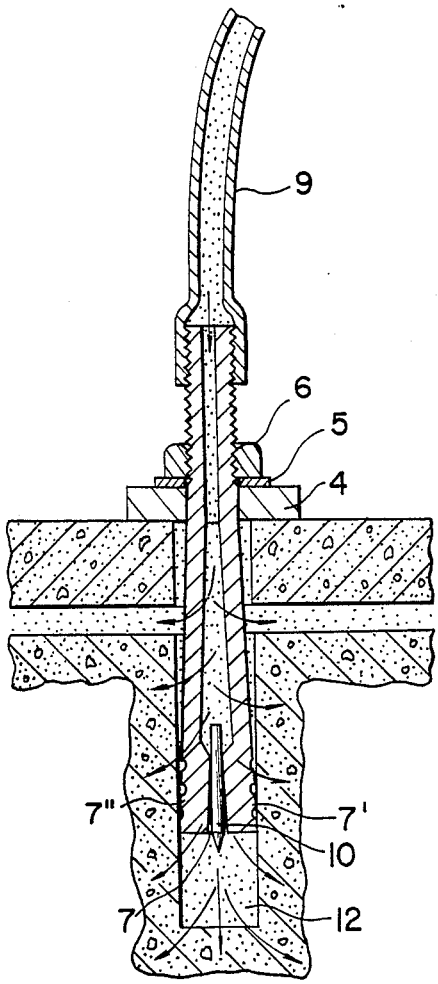
Figure 4:
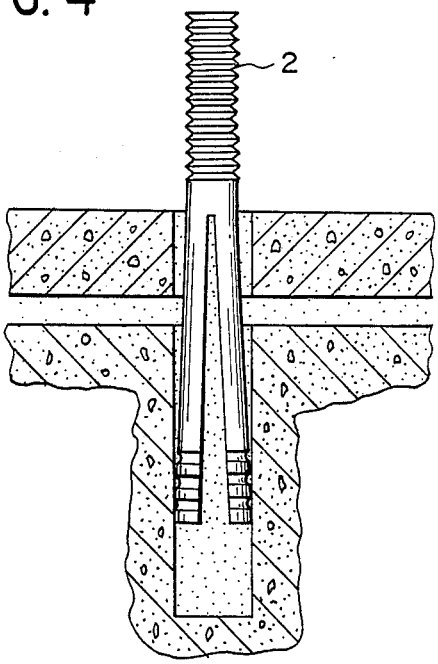
Figure 5:
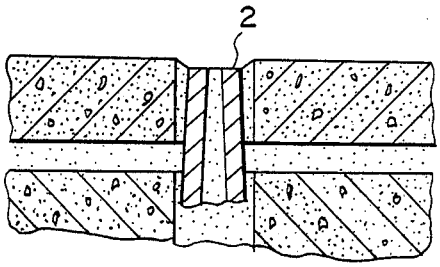
Figure 6:
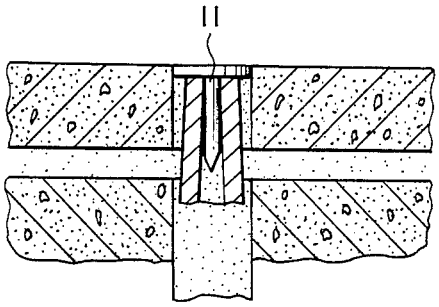

At a central portion of the peeled-off mortar (or a bond), a hole with a diameter somewhat larger than that of the pin for injecting a grout material is perforated; and thereafter said pin is inserted thereinto. The packing 4 and the washer 5 fitted onto said packing 4 are inserted, thereby softly fixing the washer based nut 6 thereto by the screw thread 2. Thus, the grout pin 10 is knocked into the base of the cylinder by means of the knock pin 11. At that time, the front portion of the pin, i.e. both tongued pieces 7', 7'' are expanded to open, thereby thrusting the pin into the concrete (FIG. 2). At that time, the nut 6 is clamped so as to fix the packing 4 thereto under pressure. Under such conditions as above, the pin for injecting a grout material is kept in a suspended condition. Then, a grout pipe 9 is connected thereto so as to inject the grout material (FIG. 3). Thus, the grout material is injected into a space to be treated formed on the whole of the end faces of the tongued pieces 7', 7'' from every position of the slit. As a result of said injection, the grout material causes the excretion of water which exists in the spaces of the grout material. After confirming the hardening of an adhesive agent, the nut and packing 4 are respectively taken off (FIG. 6). In this manner, the adhesive agent can be filled up the spaces without causing rises of the mortar surface (a tile) layer to be thus treated owing to an injection pressure in carring out the execution of workings.

Lastly, a head portion of the grout pin is cut to a concave shape by means of a grinder (FIG. 5) and thereafter a pin with a disc head is knocked into the hole of the grout pin (FIG. 6).

At that time, the head of the pin can retain the mortar layer; and at the same time the grout pin can serve as an anchor.

I claim:

1. A pin for injecting a grout material comprising:

an elongated cylindrical body having an upper section terminating in a top end and a lower section terminating in a bottom end;

an elongated hole extending through said body from end to end;

an elastomeric packing disposed about a portion of said upper section;

said upper section having screw threads extending downwardly from said top end;

a nut engaging said threads above said packing;

a first pin extending into said hole from said top end, said first pin having a top extending beyond said cylindrical body top end;

a slit extending upwardly through said lower section from said cylindrical body bottom end dividing said lower section into first and second tongues; and, a second elongated pin positioned within said hole between said tongues, whereby when said first pin is driven downwardly it engages said second pin to drive said second pin downwardly and thereby separate said tongues.

2. The invention in accordance with claim 1 wherein the lower end of said second pin tapers to a point.

3. The invention in accordance with claim 1 wherein said lower section comprises a major portion and said upper section comprises a minor portion of said cylindrical body.

4. The invention in accordance with claim 1 wherein the outer surface of a portion of said lower section extending from said bottom end is knurled.

5. The invention in accordance with claim 1 wherein the diameter of said elongated hole in said lower section is less than the diameter of said elongated hole adjacent to said lower section.

* * * * *